US005139247A

United States Patent [19]

Meschi

[11] Patent Number: 5,139,247

[45] Date of Patent: Aug. 18, 1992

[54] HIGH SPEED FOLDING MACHINE FOR ELASTIC MATERIAL BANDS

[75] Inventor: Luciano Meschi, Castiglioncello, Italy

[73] Assignee: Industria Grafica Meschi S.r.l., Livorno, Italy

[21] Appl. No.: 744,816

[22] Filed: Aug. 12, 1991

Related U.S. Application Data

[63] Continuation of Ser. No. 430,512, Nov. 1, 1989, abandoned.

[30] Foreign Application Priority Data

Nov. 7, 1988 [IT] Italy ..... 22536 A/88

[51] Int. Cl.[5] ..... B41L 1/32

[52] U.S. Cl. ..... 270/39; 270/32; 493/411

[58] Field of Search ..... 270/30, 31, 32, 39; 493/410–415

[56] References Cited

U.S. PATENT DOCUMENTS

| | | | |
|---|---|---|---|
| 3,770,264 | 11/1973 | Sturnman | 493/413 |
| 4,838,848 | 6/1989 | Lenzi | 270/39 |

FOREIGN PATENT DOCUMENTS

| | | | |
|---|---|---|---|
| 2704502 | 8/1978 | Fed. Rep. of Germany . | |
| 3708016 | 9/1988 | Fed. Rep. of Germany . | |
| 55-101551 | 8/1980 | Japan | 493/413 |
| 58-220061 | 12/1983 | Japan | 493/412 |
| 60-183467 | 9/1985 | Japan | 270/39 |
| 63-112369 | 5/1988 | Japan | 270/31 |
| 2177686 | 1/1987 | United Kingdom . | |

*Primary Examiner*—Edward K. Look

*Assistant Examiner*—Therese M. Newholm

*Attorney, Agent, or Firm*—McAulay Fisher Nissen Goldberg & Kiel

[57] ABSTRACT

Machine for high speed folding in an accordion-like manner of bands of elastic materials such as paper, thin plastic laminates or metal sheets coming from coils onto which are stored in a rolled up form, comprising an orientable guide (104) launching the band (102) against an obstacle (24, 26) so as to cause a length of the band to be bent into an arc-shaped manner, thus forming a loop (150), towards a first roller (20) having circumferential grooves (40) and areas (136, 138, 140) having high friction coefficient with respect to the material of the band to be folded, the roller (20) being rotated at a speed such that its peripheral speed is greater than the advancing rate of the band (102), whereby the loop (150) formed by the band is drawn by the roller (20) up to impinge against releaves (32) engaged within the circumferential grooves (40), causing the band (102) to be pinched, thus forming a sharp fold and then to start again the arc-shaped folding in the opposite direction until it comes into contact with the loop a second roller (22), fully identical to the first one (20), whereby the band is pinched between the roller (22) and corresponding releaves (36) engaged in circumferential grooves thereof (44), the band being thus sharply folded again and returned towards the first roller (20), and so on, whereby an accordion-folded package of band (166) is formed up to the desired size. The presence of possible crossing weakening areas in the band at regular spacings makes the size of the accordion folded zone essentially independent from the distance between the first and second rollers (20, 22).

25 Claims, 3 Drawing Sheets 10
12
14
16
18
20
21
22
23
24
25
26
27
28
30
32
34
36
38
40
42
44
46
48
50
52
54
56
58
60
62
64
66
68
70
72
74
76
78
80
82
84
86
88
90
92
94
96
98
100
102
104
108
111
112
114
116
118
122
122a
124
124a
130
132
150
150a
150b
I
III

HIGH SPEED FOLDING MACHINE FOR ELASTIC MATERIAL BANDS

This application is a continuation of application Ser. No. 07/430,512, filed Nov. 1, 1989, now abandoned.

The present invention relates to a machine for accordion-like folding of bands of not very rigid elastic materials such as paper, paperboard, plastic laminates, metal sheets etc., in layers having all essentially an equal length at a very high rate without using any particular means by which the spacing between the folds is measured and controlled.

This machine is particularly useful in the preparation of paper for high speed printers as an accordion-like folded band to form packages containing a predetermined number of loops, starting from a virgin band rolled up as a coil, as it normally comes from the manufacturing shop.

A number of methods and mechanisms is known to accordion like fold a paper band for high speed printers to form packages having a desired size containing a paper band having side advancing holes and weakened areas for the tearing at regular intervals.

Among them the mostly known comprise the laying down of band loops folded by periodically acting mechanisms such, as helicoidal spirals rotating along their axis, onto a conveying band onto which the package is formed in inclined manner, with the loops flake-wise superimposed, the package being subsequently redressed either manually or by means of any simple mechanism and lastly separated and prepared for the carrying out.

According to another method there are provided cylinders having sucking zones to drag the band paper and funnel shaped guiding means which, by alternatively moving rightwise and leftwise perpendicularly to the advancement direction of the paper, cause the latter to be laid down in a zig-zag manner, thus forming the beginning of an accordion like folding. Other methods exist by which the folding is carried out after predetermined band length are passed and sophisticated devices are involved containing synchronous or stepped motors to deliver the predetermined length and cause the folding to take place at the desired point.

The methods of the prior art as above described are all either subjected to complications for intermediates or additional steps in the package forming or to limitation of production rate depending on the technological level of the mechanism which render very complicated the package forming process and cause it to be easily liable to registration losses which involve time consuming adjustment or substitutions when the size of the band length forming the packages must be changed.

A first purpose of the present invention is that of providing a high speed folding machine for thin bands of elastic materials, such as paper, permitting said bands to be folded in an accordion-like manner at a very high rate forming packages which are in the already redressed situation and require a minimum of subsequent processing for their final packaging.

Another purpose of the present invention is that of preparing packages of paper band accordion-like folded in which the size, both as length and as height, may be changed through simple adjustment of components of the folding machine without any need of substitution of parts.

A further purpose of the present invention is that of preparing packages of paper band the size of which may be predetermined in a precise manner, for example, imposing weaking areas at modular spacings in the band, and which remain precise notwithstanding minor size changes of components of the folding machine.

The method of the present invention is essentially based on the fact that a paper sheet or a sheet of whatever laminate of similar consistency if advanced up to an obstacle is contacted, begins to take an arc shape, forming a loop increasingly narrower as the sheet is pushed against the obstacle, whereby, if the said loop near the apex thereof is carried by a roller, the peripheral speed of which is higher than the advancing speed of the sheet, and is made to impinge against the fixed obstacle, being engaged with the roller surface so that it cannot be overcome by the sheet, said loop is definitely pinched whereby the sheet takes a straight fold line and subsequently this sharp folding line, by remaining abutted against said obstacle into engagement with the roller acts as a stop whereby the sheet continuously advancing is formed as an arc in the opposite direction with respect to the preceding one, the loop of which is more and more narrowed, as the sheet advances, being removed from the obstacle until the loop near its apex is carried by a second roller, the peripheral speed of which is higher than the advancing speed of the sheet and is compelled to impinge against the fixed obstacle, into engagement with the surface of said second roller, whereby it cannot be overcome by the sheet, said loop being sharply pinched, thus giving to the sheet a straight folding line which, by remaining into abuttment against said obstacle engaged with the roller, acts as a stop inverting the arc formed by the sheet which at the very end takea a zig-zag configuration forming the desired accordion like folding.

A device by which the method of the present invention is embodied consists of a supporting plane, above which guiding means are provided for the sheet or band and alternatively guiding said band when it is introduced in order to have it impinging against a first or a second one of said obstacle each one of which limitates one of the two opposite sides of said supporting plane and above said first and second obstacles there being provided roller means rotating at a speed such that their peripheral speed is higher than the advancing rate of the band whereby a loop generated in said band owing to the abutting thereof against that of the two obstacles towards which it is initially guided by said guiding means is dragged by that of the roller means opposite with respect to said obstacle against the opposite obstacle which is engaged with said roller means to prevent the band from passing under the same, forming in the band itself a straight and sharp fold which causes the direction of loop formation of the sheet to be inverted, whereby it is brought towards the opposite of said roller means and the forming of said sharp and straight folds is continuously alternated between the two opposite roller means forming an accordion like folded band.

Particularly, the two obstacles opposed to the two sides of the said supporting plane consists of two substantially U-shaped frames, pivotally connected to the rotation shafts of said roller means and depending therefrom, by which the lower halves of said roller means are encompassed and interposed between said roller means and said supporting plane.

The said two frame shaped side obstacles are provided with means preventing the band from entering between themselves and the plane or the roller means consisting of releaved parts engaging corresponding grooves in the same supporting plane and in the roller means.

The said releaved parts on said frames consists of parallelepipedal blocks entering the corresponding groups of the supporting plane and of the roller means.

Said parellelipipedal blocks are provided with cross cuts giving them a comb appearance.

Said roller means are supported by first lever arms having on second arms means adapted to counterweight the weight of said rollers.

Preferably said means adapted to oppose the weight of said rollers means consists of a counterweight giving to said levers counterbalance moments slightly lower than those resulting from the weight of said roller means. Alternatively, said means, adapted to counterbalance the weight of said roller means consist of springs adjusted so that counterbalance moments applied therefrom to said levers are slightly lower than those resulting from the weight of said roller means.

Preferably said frame shaped obstacle depending from the shafts of said roller means are provided with compression springs keeping said obstacles against a package of accordion like folded band already accumulated therebetween.

More preferably said frame shape obstacles are furthermore provided with stops preventing them from being removed beyond a certain distance from each other in order to keep constant the longitudinal size of the band lengths forming the package.

According to a first embodiment of the invention the rollers which are lifted by the band package being formed thereunder, when such rollers attain a certain height actuate control means which cause the supporting plane on which said accordion like folded band package is formed to be gradually lowered.

Preferably, said control means consists of at least a microswitch, actuated by the position taken by at least one of said rollers, controlling a gradual lowering of said supporting plane.

More preferably said at least one microswitch is actuated by the position taken by one of the arms of one of said levers supporting said rollers. Still more preferably, one of the arms of said levers supports a member of adjustable length such as a bolt screwed onto a releaved part, which is brought from the position of the levers into engagement with the actuating element of a microswitch.

Alternatively, said microswitch can be secured to one arm of said lever and the member of adjustable length can be fastened to a releaved part connected to supporting structures of the device.

Said guiding means positioned above said supporting plane consists of an assembly comprising at least a pair of moving rollers, tending to be abutted against each other, followed by two planar plates, parallel and spaced by an interval sufficient for the passing of a band to be guided, which can be oriented as desired towards one of the two side obstacle to have the band loop starting at the desired part.

Preferably said assembly of rollers and parallel plates is housed within a frame supported by a rotation shaft, actuated by motor means, in order to be orientable towards the selected one of the said obstacles.

More preferably said motor means for the orientation of said frame consists of an electromagnetic actuator.

Alternatively said motor means consist of a pneumatic actuator.

In a preferred embodiment of the present invention said motor means cause said guiding means to be oriented for the time necessary to bring the leading end of the band to be folded against the selected said obstacles and then are switched off to permit said guiding means to remain in a central position permitting alternated foldings of said band.

In order to complete the action of guiding and of bringing the band towards the supporting plane and said rollers, there is provided above the frame supporting the guiding means assembly at least a pair of rollers mutually abutting against each other and driven by a motor at the same peripheral speed as at least two rollers present in the assembly of guiding means.

In a particularly preferred embodiment of the present invention, relating to the particular accordion-like folding of bands in fixed lengths, said bands are provided with weakening lines at regular interval or length permitting the folding of said bands in lengths in all equal to each other with a good tolerance with respect to the position of said obstacles and of the above positioned rollers with respect to the supporting planes.

Lastly said roller means consists of two cylindrical rollers driven in mutually opposed directions, to bring the band against said obstacles, at essentially equal speeds, provided with groups having shapes mating the shape of the combs provided on the obstacles positioned sidewise with respect to the supporting plane, and with areas coated with material promoting the adhesion of said band to said rollers.

More particularly, said material promoting the adhesion of the band to the rollers is an elastomeric material such as natural or synthetic rubber or flexible plastic materials.

The features and advantages of the invention, together with its further features and advantages shall be better understood from the following detailed description of the preferred embodiment, to be not construed in limitating sense, with reference to the enclosed drawings in which.

Figure 1:
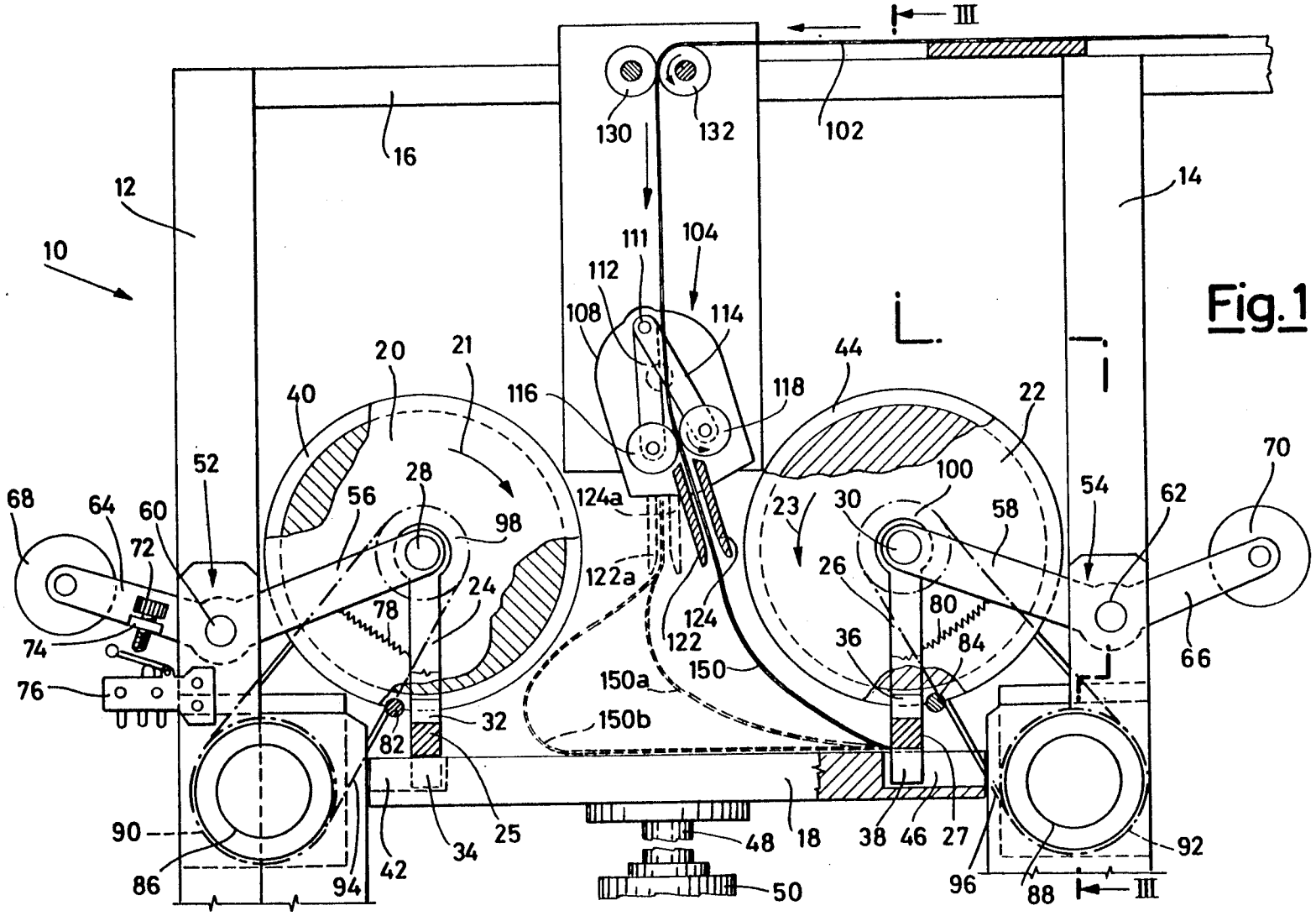
FIG. 1 is a front elevation view of a device embodying the folding method of said band according to the present invention wherein the band begins to arrive in order to undergo the first folding in said device.
Figure 2:
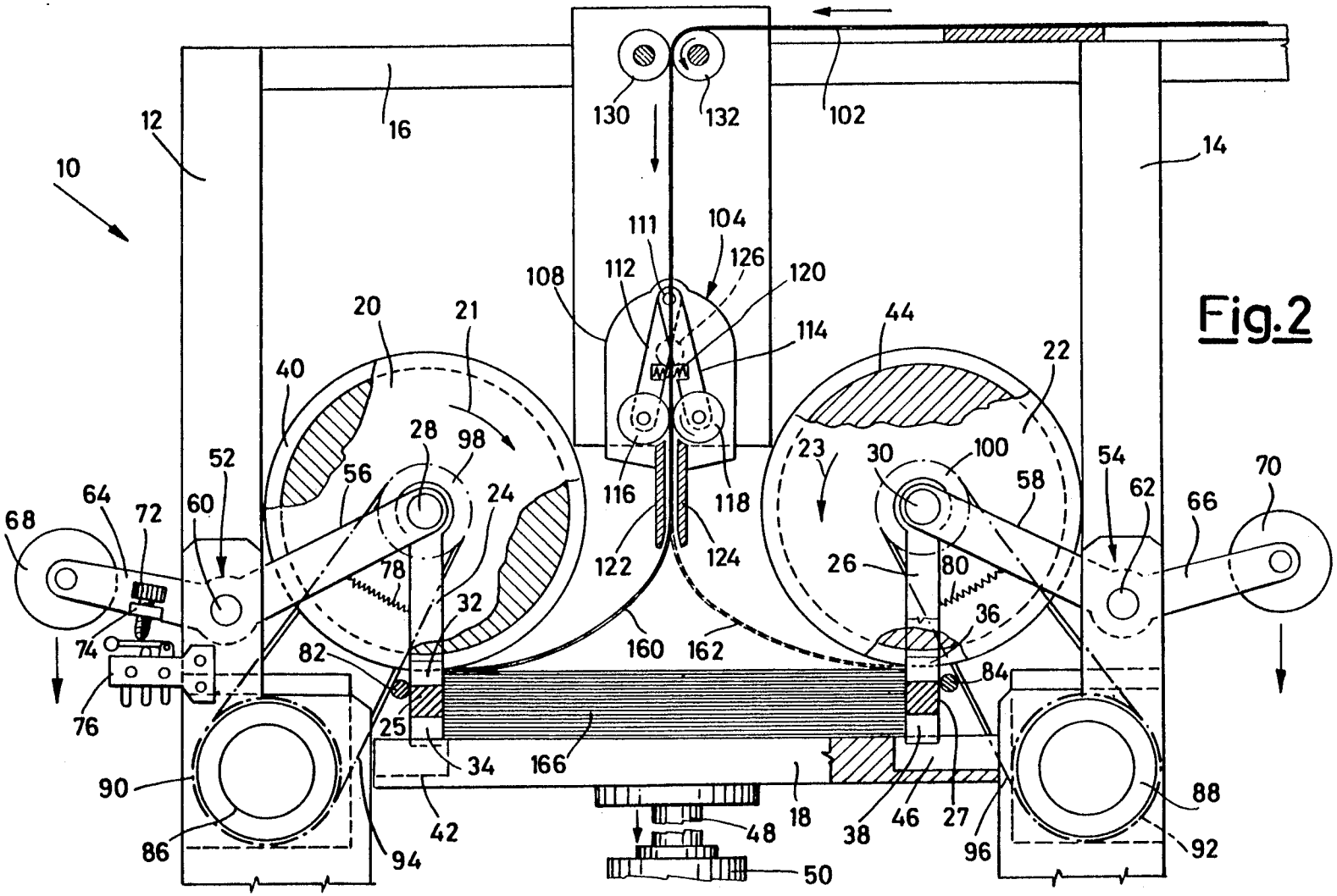
FIG. 2 is an elevation view from the identical view point as FIG. 1 of the same folding device according to the present invention when part of a band package has been already formed onto the supporting plane.

Referring to the drawings, it can be seen that a folding mschine according to the invention consists of a supporting frame 10 composed by posts 12, 14, 15 and by cross bars, such as the cross bar 16 with can be seen in the FIGS. 1 and 2, within which a supporting plane 18, two rotating cylindrical rollers 20 and 22, two obstacle means 24 and 26 in form of U-shaped frames pivotted around axes 28 and 30 of said respective cylindrical rollers 20 and 22 and interposed with respective cross bars 25 and 27 between said rollers and said supporting plane 18, are provided.

Figure 3:
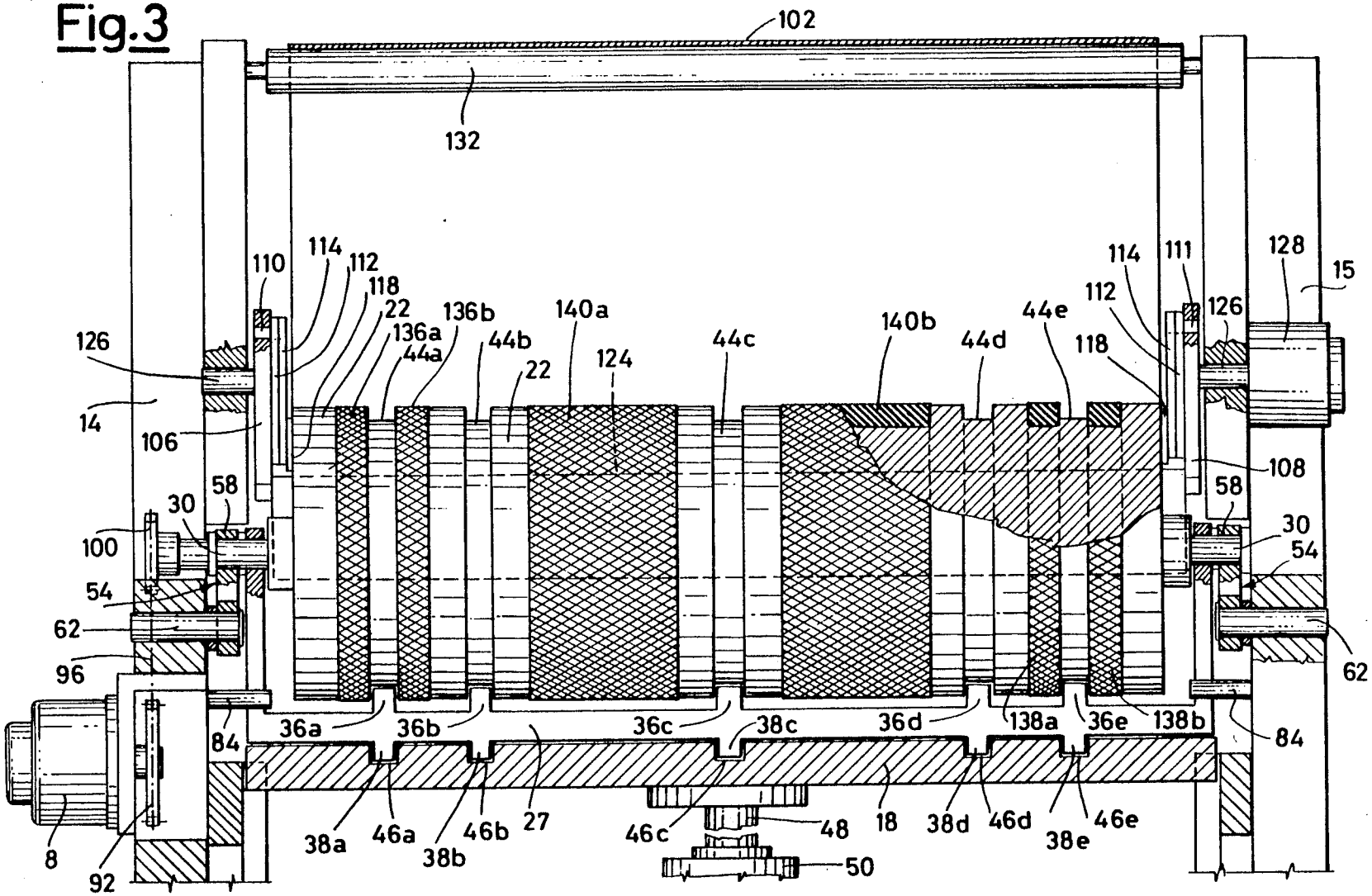
FIG. 3 is a side view taken along the line III—III of FIG. 1 with part in cross section and part removed to show several details of the invention.

Particularly said U-shaped frames 24 and 26 are provided with releaved parts such as the releaves 32, 36, and 38 seen in the FIGS. 1 and 2, or the relieves 36 (*a–e*) and 38 (*a–e*) shown in FIG. 3, engaging corresponding groups 40, 42, 44 and 46 or 44 (*a–e*) and 46 (*a–e*) showing the first ones in FIGS. 1 and 2 and second ones in FIG. 3.

The said supporting plane 18 is mounted to a column 48 which is driven by positioning means 50 to determine the position of the supporting plane 18 with respect to the cylindrical rollers 20 and 22, and to the U-shaped frames 24 and 26.

The cylindrical rollers 20 and 22 are suspended with respect to the frame 10 and to the supporting plane 18 by means of two double levers 52 and 54 the first arms of which 56 and 58 support for the rotation said axes 28 and 30 of the cylindrical rollers 20 and 22 and are pivotally connected to the axis 60 and 62, from which the second arms 64 and 66, originate provided with counterweights 68 and 70 adapted to counterbalance, at least partially, the weight the cylindrical rollers 20 and 22. As particularly shown in the FIGS. 1 and 2, the second arm of the lever 52 comprises an adjustment screw or bolt 72 into engagement with a screw threaded hole of a releaved part 74 rigidly connected to said second arm in order to engage a microswitch 76 secured to the post 12 of the frame 10 for the hereinafter described function.

It is to be noted that the U-shaped frames 24 and 26 are pivotally connected to the axes 28 and 30 of the cylindrical rollers 20 and 22 but are independent from the first arms 56 and 58 of the levers 52 and 54 from which are kept spaced, further by their weight tending to keep them in the vertical position, also by springs 78 and 80 compression acting between said first arms 56 and 58 and said U-shaped frames 24 and 26, their displacements movements being moreover limited by stopping pins 82 and 84 connected to said frame 10 of the folding machine.

The two cylindrical rollers 20 and 22 are driven into rotation according to mutually opposed direction by means, such as electrical motors, 86 and 88 respectively, which through gears 90 and 92 and the transmission means 94 and 96, such as chains or toothed belts, drive gears 98 and 100 connected rigidly to the axis 28 and 30 of said cylindrical rollers 20 and 22.

Considering now the initial guiding means of the band 102, which preferably is a paper band, said means consists of a case 104 containing at least two flanges 106 and 108, a pair of upper pins 110 and 111 to which there are pivoted two pair of arms 112 and 114 supporting to cylindrical rollers 116 and 118 and maintained close to each other by elastic means, such as the spring 120, two planar guide plates 122 and 124 and a shaft 126 for the orientation of the whole case 104, which can be driven into movement by external motor means 128.

The paper band itself 102 coming from an outer supply, such as a coil (not shown) comes, after possible preliminary operations, such as the provision of holes along the edges and the provision of possible weakening lines at regular periodic lengths to promote the folding of the band at the desired points, to a pair of actuated cylinders 130 and 132 by which said band is deviated towards the case 104 of the guiding means to bring it to distribution and folding which takes place in said folding machine of the present invention.

The two cylindrical rollers 20 and 22, further to have the groups 40 and 44 illustrated in the FIGS. 1 and 2, or the grooves 44 (*a–e*) shown for the cylindrical roller 22 in FIG. 3, are provided with areas of greater adherence 136*a*, 136*b*, 138*a*, 138*b*, 140*a* and 140*b* (all shown in FIG. 3) which may consist of suitable rubber or plastic material ribbons fixed in proper groups provided in the periphery of cylindrical rollers 20 and 22.

The operation of the invention is as follows:

When a package of an accordion like folded band is to be started, one end of the paper band 102 is directed from the case 104 towards the side of the supporting plane 18 at which the package must be started, for instance the side defined by the U shaped frame 26, by inclining the case 104 with the planar guide plates 122 and 124 directed towards said U shaped frame 26 (moving towards the right side as viewed in FIG. 1).

The end of the paper band 102 is downwardly advanced until it impinges against the supporting plane 18 and, owing to the pushing action of the pairs of the cylindrical rollers 116, 118 and 130, 132 continues to slide onto said plane until it comes into contact with the cross bar 27 of the frame 26, which cannot be overcome by insertion under, owing to the releaves 38 (*a–e*), which are particularly shown in FIG. 3, preventing said band 102 from passing between the crossbar 27 and the plane 18. Under the pushing action of the two aforesaid rollers pairs 116, 118 and 130, 132 the band starts taking an arc shape according to an arc 150 which subsequently, owing to the fact that the case 104 leaves the position of FIG. 1 to take the position shown in FIG. 2 with the planar guide plate 122 and 124 taking the orientation shown as 122*a* and 124*a*, and becomes the loop 150*a* (as shown in dashed outline) which, owing to the next advancing of the band, becomes the loop 150*b* (as shown in dashed outline) which comes more and more closer to the cylindrical roller 20 rotating in the direction indicated by the arrow 21 at a speed such that the peripheral speed of the roller is definitely higher than the advancing rate of the band 102.

When the loop 150*b* by expansion comes into contact with said roller 20, the latter has onto the band an effect similar to that of a hand flattening a folded sheet to originate a sharp fold in a desired point.

The loop 150*b* as a matter of fact is drawn by the roller 20 until it inpinges against the relieves 32 of the cross bar 25 of the U-shaped frame 24 providing in the band a sharp well flattened fold which, by the way, causes the curvature of the loop 150*b* to be inverted, being transformed into the arc 160 shown in (full outline in) FIG. 2.

Said arc owing to advancing of the band will be transformed then into a loop more and more curved becoming closed to the roller 22, rotating in the direction indicated by the arrow 23, until the latter takes to impinge against the relieves 36 (*a–e*) particularly shown in FIG. 3, undergoing again a sharp folding with inversion of the curvature into an arc 162 (shown in dashed outline) which will increase becoming a loop which at that time will approach again the roller 20; said forming of arcs becoming loops and then inverting when the band 102 comes into contact against said rollers 20 and 22 is thus continued in alternated manner forming a package 166 of an accordion like folded band between the two U shaped frames 24 and 26 sidewise limiting the supporting plane 18.

The length of the package 166 and defined by the distance between the cross bars 25 and 27 of the U shaped frames 24 and 26 and is kept essentially constant on the whole package since, allthough the rotation of the levers 52 and 54 in order to raise the rollers 20 and 22 should cause the two U-shaped frames 24 and 26 to be removed from each other. However, the action of the compression springs 78 and 80 compensate for the removal and lastly the presence of the stopping pins 82 and 84 and finally limits the displacement outwardly of the U shaped frames 24 and 26. The said package 166 grows by occuping the space between the rollers 20 and 22 and the supporting plane 18 and, when said space is fully occupied, owing to the fact that the band is continuously drawn under the two said rollers 20 against the cross bars 25 and 27, the package causes the rollers 20 and 22 to be raised, and the counterweight 68 and 70 provided on the supporting levers 52 and 54 counterbalances the rollers 20 and 22.

The height of said packaged 166 increases until the screw 72 screwed within a relief 74 rigidly connected to the arm 64 of the lever 52 actuates the microswitch 76 thus controlling positioning means 50 by which the supporting column 48 of the supporting plane 18 is gradually lowered whereby a further growth of the package 166 is permitted.

The growth of the package 166 is continued until, in any manner, it is completed and consequently the band 102 is cut whereby its folding to form said packages is stopped.

The package 166, once completed, is removed from the supporting plane 18 and delivered to further packaging processing, for the storage or delivery.

The above is only a preferred embodiment of the present invention and it will be obvious that all equivalent means to realize the component of the invention are to be considered as hereby covered such as, for example the use of calibrated springs instead of the counterweight 68 and 70, the use of also a second microswitch to signal also the raising of the roller 20 instead of only one microswitch 76 to signal the raising of the roller 20 and, instead of the column 48 and of the positioning means 50 to lower or raise the supporting plane 18 a threaded shaft actuated by a reducing gear motor unit and into engagement within a threaded hole passing in a suitable position through the supporting plane 18 might by used.

I claim:

1. Folding machine for the folding of a sheet in a form of a continuous band in an accordion-like manner, comprising:

a supporting plane (18) and means above said supporting plane for feeding a sheet in the form of a continuous band (102) towards said supporting plane, said supporting plane and said feeding means forming means for alternatively guiding the band (102) when it is introduced in order to have it impinging alternately against a first and a second obstacle (24, 26), each of said obstacles limitating one of the two opposite sides of said supporting plane (18);

roller means (20, 22) above each of said first and second obstacles (24, 26), each of said roller means rotating at a speed such that their peripheral speed is higher than the advancing rate of the band (102) whereby a loop (150) is generated in said band owing to the abutting thereof against one of said obstacles (26) of said two obstacles towards which it is initially guided and dragged by said roller means (20) opposite with respect to said one obstacle (26) against the other obstacle (24) which is engaged with said roller means (20) to prevent the band (102) from passing under the same (102) and forming in the band itself a straight and sharp fold for causing the direction of loop formation of the sheet to be inverted, whereby it is brought towards the opposite of said roller means (22) and the forming of said sharp and straight folds is continuously alternated between the two opposite roller means (20, 22) forming the accordion-like folded band; and said obstacles being opposed to the two sides of said supporting plane (18) and consisting of two substantially U-shaped frames (28, 30), said roller means (20, 22) having rotation shafts pivotally connected to said U-shaped frames, and said U-shaped frames depending from said rotation shafts, and the lower halves of said roller means (20, 22) being encompassed and interposed between said roller means and said supporting plane (18).

2. Folding machine according to claim 1, wherein said two obstacles (24, 26) are frame-shaped and provided with means (32, 34, 36, 38) preventing the band (102) from entering between themselves and said plane (18) or the roller means (20, 22) consisting of releaved parts engaging (40, 42, 44, 46) corresponding grooves in the same supporting plane (18) and in said roller means (20, 22).

3. Folding machine according to claim 2, wherein said releaved parts (32, 34, 36, 38) on said frames (24, 26) include parallelepipedal blocks entering said corresponding grooves (40, 42, 44, 46) of said supporting plane (18) and of said roller means (20, 22).

4. Folding machine according to claim 3, wherein said parallelepipedal blocks are provided with crossing cuts having a comb appearance.

5. Folding machine according to claim 1, wherein said roller means (20, 22) are supported by first arms (56, 58) of first class levers (52, 54) having on second arms (60, 62) means opposing the weight of said roller means (20, 22).

6. Folding machine according to claim 5, wherein said means opposing the weight of said roller means (20, 22) includes counterweights (68, 70) giving to said levers (52, 54) counterbalance moments slightly lower than those resulting from the weight of said roller means (20, 22).

7. Folding machine according to claim 6, wherein said means (20, 22) opposing the weight of said roller means (20, 22) includes springs adjusted so that counterbalancing moments applied therefrom to said levers (52, 54) are slightly lower than those resulting from the weight of said roller means (20, 22).

8. Folding machine according to claim 2, wherein said two frame-shaped obstacles (24, 26) depending from the shafts (28, 30) of said roller means (20, 22) are provided with compression springs (78, 80) keeping said obstacles (24, 26) against a band (166) of an accordion-like folded band already accumulated therebetween.

9. Folding machine according to claim 8, wherein said frame-shaped obstacles (24, 26) are furthermore provided with stops (82, 84) preventing them from being removed beyond a certain distance from each other in order to keep constant the longitudinal size of the band lengths (102) forming the package (166).

10. Folding machine according to claim 8, wherein said roller means includes rollers (20, 22) which are lifted by said band package (166) being formed thereunder, when attaining a certain height to actuate control means which cause the supporting plane (18) on which said accordion-like folded band package (166) is formed to be gradually lowered.

11. Folding machine according to claim 10, wherein said control means comprises at least a microswitch (76)

actuated by the position taken by at least one of said rollers (20, 22) controlling a gradual lowering of said supporting plane (18).

12. Folding machine according to claim 11, wherein said at least one microswitch (76) is actuated by the position taken by one of the arms (64, 66) of one of said levers (52, 54) supporting said rollers (20, 22).

13. Folding machine according to claim 12, wherein one of the arms (64, 66) of said levers (52, 54) supports a member of adjustable length (72) such as a bolt screwed onto a releaved part (74), which is brought from the position of the levers (52, 54) into engagement with an actuating element of said microswitch (76).

14. Folding machine according to claim 12, wherein said microswitch (76) can be secured to one arm (64, 66) of said lever (52, 54) and the member of adjustable length (72) can be fastened to a releaved part connected to a supporting structure of the device.

15. Folding machine according to claim 1, including guiding means (104) positioned above said supporting plane for guiding the sheet in the form of the continuous band between said supporting plane (18) and said feeding means, said guiding means cooperating with said feeding means for initially guiding said sheet towards said one of said obstacles.

16. Folding machine according to claim 15, wherein said guiding means (104) positioned above said supporting plane (18) includes an assembly comprising at least a pair of moving rollers (116, 118), tending to be abutted against each other, followed by two planar plates (122, 124), parallel and spaced by an interval sufficient for the passing of the band (102) to be guided, which can be oriented as desired towards one of the two side obstacles (24, 26) to have the band loop starting at the desired side.

17. Folding machine according to claim 16, wherein said assembly of rollers and parallel plates are housed within a frame (104) supported by a rotation shaft (126), actuated by motor means (128) for orientation towards a selected one of said obstacles (24, 26).

18. Folding machine according to claim 17, wherein said motor means (128) comprises an electromagnetic actuator.

19. Folding machine according to claim 17, wherein said motor means (128) comprises a pneumatic actuator.

20. Folding machine according to claim 16, wherein said motor means (128) cause said guiding means to be oriented for the time necessary to bring out the leading end of the band (102) to be folded against the selected one of said obstacles (24, 26) and then are switched off to permit said guiding means to remain in a central position permitting alternating foldings of said band (102).

21. Folding machine according to claim 1, including a frame (104) for supporting a guiding means assembly to complete the action of feeding and for guiding the band (102) to bring towards the supporting plane (18) and said roller means (20, 22), and said feeding means including a pair of rollers (130, 132) above the frame (104) supporting the guiding means assembly, said pair of rollers (130, 132) mutually abutting against each other and being driven by a motor at the same peripheral speed as at least two rollers (116, 118) present in said guiding means assembly.

22. Folding machine according to claim 1, wherein said band (102) is provided with weakening lines at regular interval or lengths for permitting the folding of said band (102) in lengths all equal to each other with a good tolerance with respect to the position of said obstacles (24, 26) and said roller means (20, 22) with respect to the supporting plane (18).

23. Folding machine according to claim 1, wherein said roller means (20, 22) includes two cylindrical rollers driven in mutually opposed directions, to bring the band against said obstacles (24, 26) at essentially equal speeds, provided with groups (40, 44) having shapes mating the shape of combs (32, 36) provided on the obstacles positioned sidewise (24, 26) with respect to the supporting plane (18), and with areas (136–140) coated with material promoting the adhesion of said band (102) to said rollers (20, 22).

24. Folding machine according to claim 23, wherein said material promoting the adhesion of the band (102) to the rollers (20, 22) is an elastomeric material such as natural or synthetic rubber or flexible plastic materials.

25. Folding machine according to claim 1, wherein said feeding means includes a pair of rollers (130, 132) mutually abutting each other between which said sheet is guided towards said supporting plate (18) by said two side obstacles (24, 26) to impart a zig-zag configuration to the sheet to form an accordion-like of the sheet remaining in abutment with said fixed obstacles.

* * * * *